US005355206A

United States Patent [19]

Maruyama et al.

[11] Patent Number: 5,355,206

[45] Date of Patent: Oct. 11, 1994

[54] COPYING MACHINE WITH REGISTRATION ADJUSTING DEVICE

[75] Inventors: Kazuhisa Maruyama; Masaru Ushio; Junji Sato, all of Hachioji, Japan

[73] Assignee: Konica Corporation, Tokyo, Japan

[21] Appl. No.: 111,213

[22] Filed: Aug. 24, 1993

[30] Foreign Application Priority Data

Sep. 21, 1992 [JP] Japan ..... 4-251118

[51] Int. Cl.[5] ..... G03G 15/00

[52] U.S. Cl. ..... 355/317; 271/228; 271/242; 271/265; 271/275; 355/208; 355/308

[58] Field of Search ..... 355/203-204, 355/208, 308, 309, 317, 316; 271/227, 228, 242, 265, 275

[56] References Cited

U.S. PATENT DOCUMENTS

| | | | |
|---|---|---|---|
| 4,025,187 | 5/1977 | Taylor et al. | 355/317 |
| 4,214,833 | 7/1980 | Kouo | 355/309 |
| 4,429,986 | 2/1984 | Abe et al. | 355/317 |
| 4,548,394 | 10/1985 | Koyama et al. | 271/242 X |
| 5,018,718 | 5/1991 | Matsuno et al. | 355/317 X |
| 5,057,874 | 10/1991 | Miyazaki et al. | 355/317 X |
| 5,073,802 | 12/1991 | Sugiyama | 355/309 X |
| 5,112,038 | 5/1992 | Dunaway | 271/242 X |
| 5,136,342 | 8/1992 | Ida et al. | 355/317 |
| 5,278,623 | 1/1994 | Kasahara et al. | 355/317 |
| 5,298,958 | 3/1994 | Takahashi | 355/317 |

*Primary Examiner*—Matthew S. Smith
*Attorney, Agent, or Firm*—Jordan B. Bierman

[57] ABSTRACT

A copying machine in which an image of a document placed on a platen is optically read and transferred on a transfer sheet sent out from a sheet feeding cassette. The temporary stop times of transfer sheets at the registration unit are averaged after transfer sheets in each sheet feeding cassette have been copied. The obtained average is compared with a predetermined reference value. The start of the sheet feeding operation by sheet feeding cassette is advanced in accordance with the result of the comparison.

2 Claims, 7 Drawing Sheets

FIG. 5 (a) 1ST FEEDING UNIT

FIG. 5 (b) TEMPORARY STOP DETECTING SENSOR

FIG. 5 (c) BUCKLING ROLLER DRIVES

FIG. 5 (d) 2ND FEEDING UNIT

COPYING MACHINE WITH REGISTRATION ADJUSTING DEVICE

BACKGROUND OF THE INVENTION

The present invention relates to a copier.

FIG. 6 is an overall arrangement view of a conventional copying machine. A platen 1 made of a pane of transparent glass is provided in the upper center of the copying machine. A scale plate 2 to designate a setting position of document D is provided at the left end of the platen 1. A document cover 3 to cover document D placed on the platen 1 is provided in the upper portion of the copying machine. In this case, the document cover 3 can be opened and closed with respect to the platen 1.

Document D is placed on the platen 1 in accordance with the designation on the scale plate 2, and covered with the document cover 3 so that the movement of document D is restricted. A display unit 4 (not shown) in which liquid crystals of the reflection type are used is provided close to the center on the viewer's side of the platen 1.

In the copying machine, under the platen 1, there is provided a first mirror unit 12 having an exposure lamp 10 and a first mirror 11 in such a manner that the first mirror unit 12 can be linearly moved to the right and left in parallel with the platen 1 so as to scan the overall surface of document D. A second mirror unit 15 is integrally composed of a second mirror 13 and a third mirror 14. In order to maintain a predetermined optical path length, the second mirror unit 15 is moved to the right and left at half speed of the first mirror unit 12 in parallel with the platen 1.

Reflected light sent from document D placed on the platen 1 is reflected by the first, second and third mirrors 11, 13, 14. Then, the reflected light is incident upon a primary lens 16. After that, the reflected light passes through a fourth mirror 17, and is incident upon a photoreceptor drum 20 through a slit 18.

A charging electrode 21 uniformly charges the photoreceptor drum 20. Accordingly, electrostatic latent images are successively formed on the photoreceptor drum 20 rotated clockwise when exposure light is sent from the aforementioned optical system. A developing unit 22 develops the electrostatic latent image on the photoreceptor drum 20 to a visual toner image.

A sheet feeding device to feed transfer papers includes: sheet feeding cassettes 23 (in this case, two sheet feeding cassettes are shown in the drawing); first sheet feeding rollers 24 to feed transfer papers P one by one from the sheet feeding cassettes 23; second sheet feeding rollers 25 to feed transfer sheet P to the photoreceptor drum 20; and a guide plate 26 provided between the sheet feeding cassettes 23 and the second sheet feeding rollers 25, and a guide plate 27 provided between the second sheet feeding rollers 25 and a transfer electrode described later.

In a copying operation, transfer sheet P in the selected sheet feeding cassette 23 is fed by the first sheet feeding roller 24, and guided by the guide plate 26 and conveyed to the second sheet feeding rollers 25. In this case, the second sheet feeding rollers 25 (referred to as registration rollers) are driven in timed relation in which the leading end of the toner image on the photoreceptor drum coincides with the leading end of transfer sheet P. In order to conduct an accurate copying operation, in accordance with the positional difference between the sheet feeding cassettes 23, transfer sheet P is temporarily stopped at the registration rollers 25 after it has been sent out from the sheet feeding cassette 23. Synchronously when an optical scanning operation is started, the registration rollers 25 are driven in timed relation in which the leading end of the toner image on the photoreceptor drum coincides with the leading end of transfer sheet P.

A transfer electrode 28 transfers the toner image on the photoreceptor drum 20 to transfer sheet P, and a separation electrode 29 separates transfer sheet P from the surface of the photoreceptor drum 20. Transfer sheet P separated by the separation electrode 29 is conveyed to a fixing unit 31 through a transfer sheet conveyance means 30, and fixed by a thermal fixing roller and a press roller. Then, transfer sheet P is discharged onto a sheet discharge tray 33 by a discharge roller 32.

After the image transfer operation has been completed, the photoreceptor drum 20 is cleaned by a cleaning unit 34 to remove the residual toner existing on the surface of the photoreceptor drum 20. The residual toner on the photoreceptor drum surface is scraped off by a blade **34*a* provided in the cleaning unit 34. In order to conduct the toner removal operation easily, a cleaning discharge electrode 35 is provided before the blade 34*a*. After the charging electrode 21, a charge erasing unit 36 to erase the charge with rays of light is provided being opposed to the photoreceptor drum 20. Numerals 37 and 38** are respectively a precharging exposure unit and a pretransfer exposure section.

Next, a transfer sheet feeding operation will be described in which transfer sheets are sent out from the sheet feeding cassette. FIG. 7 is a schematic illustration to explain a sheet feeding control operation conducted by the registration rollers. Like parts in each of FIGS. 6 and 7 are identified by the same reference character. As shown in FIG. 40, in the sheet feeding cassette 23, a plurality of trays 40 are disposed in order to accommodate various types of transfer papers.

When a copy button (not shown) is pressed, a transfer sheet P is sent out from a predetermined tray 40 in the sheet feeding cassette 23 by the first sheet feeding roller 24. The sent transfer sheet P is conveyed to the registration rollers 25 through buckling rollers 41. Since the registration rollers 25 are not rotated at this time, transfer sheet P is curved as shown in the drawing when the buckling rollers are rotated. When a large buckle of transfer sheet P is formed, the sheet feeding operation is stopped. In order to synchronize the sheet feeding operation with the optical system, it is necessary to stop transfer sheet P at the registration rollers 25 for a predetermined period of time.

The registration rollers 25 send out transfer sheet P in synchronization with the scanning operation of the optical system. Then, the conveyance of transfer sheet P is controlled so that the leading end of transfer sheet P can coincide with the leading end of the document image to be transferred.

In order to transfer the document image in a predetermined position on transfer sheet P after transfer sheet P has been sent out by the registration rollers 25 in synchronization with the scanning operation of the optical system, it is necessary that transfer sheet P is stopped at the registration rollers 25 (the registration section) for a predetermined period of time (referred to as a temporary stop time).

However, after the copying machine has been used for a long period of time, the first sheet feeding roller 24 and other conveyance units are worn out, so that slippage is caused when transfer sheet P is sent out to the registration roller 25 by the first sheet feeding roller 24. Therefore, transfer sheet P is delayed in arriving at the registration section, so that the temporary stop time can not be ensured. For the reason described above, there is a possibility that transfer sheet P does not arrive at the registration rollers 25 even after the scanning operation has been started by the optical scanning system, and transfer sheet P is jammed.

SUMMARY OF THE INVENTION

The present invention has been achieved to solve the above problems. It is an object of the present invention to provide a copying machine in which the transfer sheet conveyance performance can be maintained at a predetermined level.

The present invention is to provide a copying machine in which an image of a document placed on the platen is optically read and transferred on a transfer sheet sent out from the sheet feeding cassette, the copying machine characterized in that: the temporary stop times of transfer papers at the registration unit are averaged after transfer papers in each sheet feeding cassette have been copied; the obtained average is compared with a predetermined reference value; and the start of the first sheet feeding operation is advanced in accordance with the result of the comparison.

When it has been found that transfer papers are delayed in arriving at the registration unit due to the deterioration with age of the first sheet feeding system, the first sheet feeding system is turned on earlier in the copying operation. Due to the foregoing, the temporary stop time can be maintained at the registration section, so that the transfer sheet conveyance performance can be maintained at a predetermined level.

DETAILED DESCRIPTION OF THE PREFERRED EMBODIMENTS

With reference to the attached drawings, an example of the present invention will be explained in detail as follows.

Figure 1:
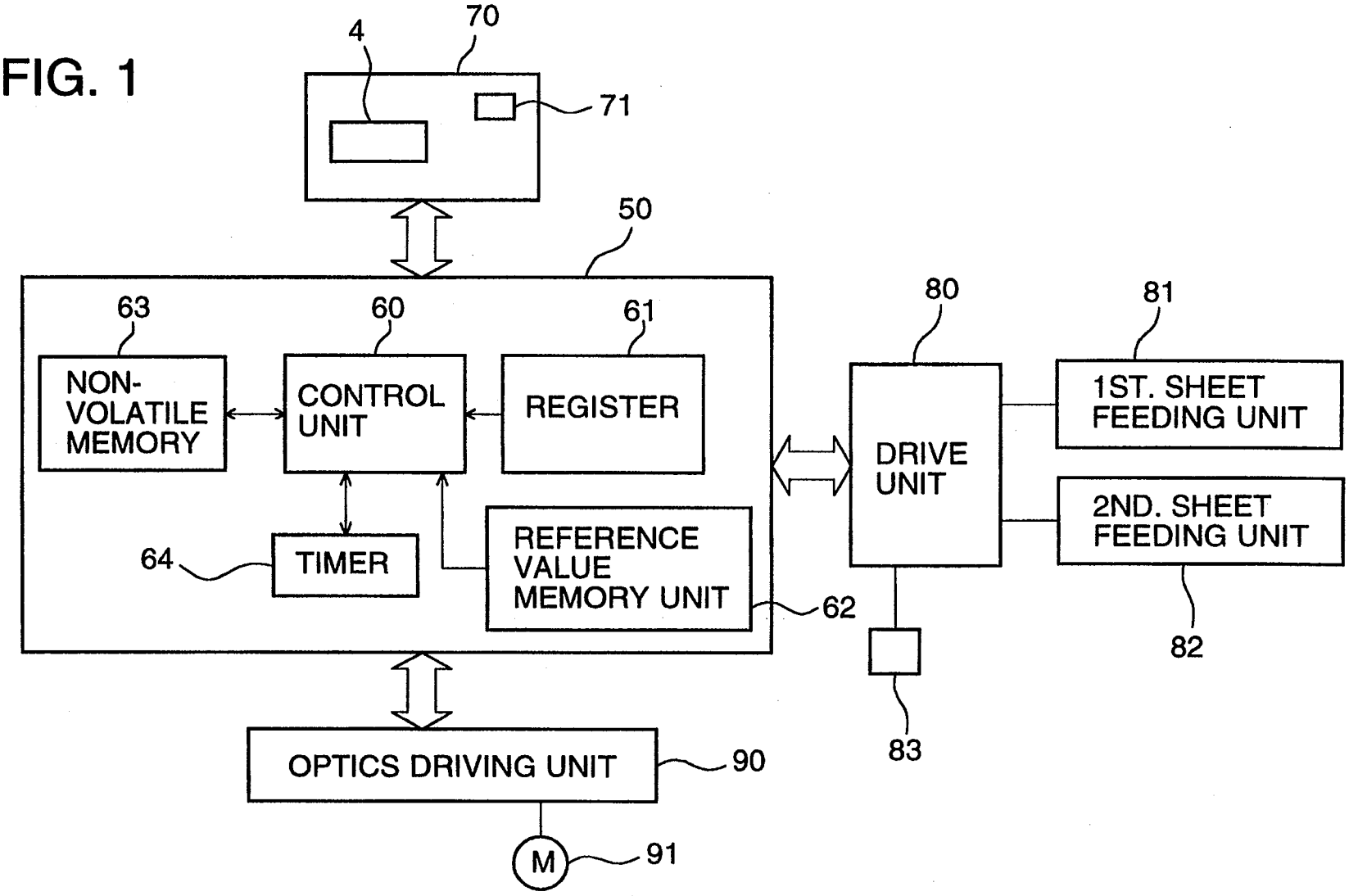
FIG. 1 is a block diagram showing the construction of an example of the present invention.
Figure 2:
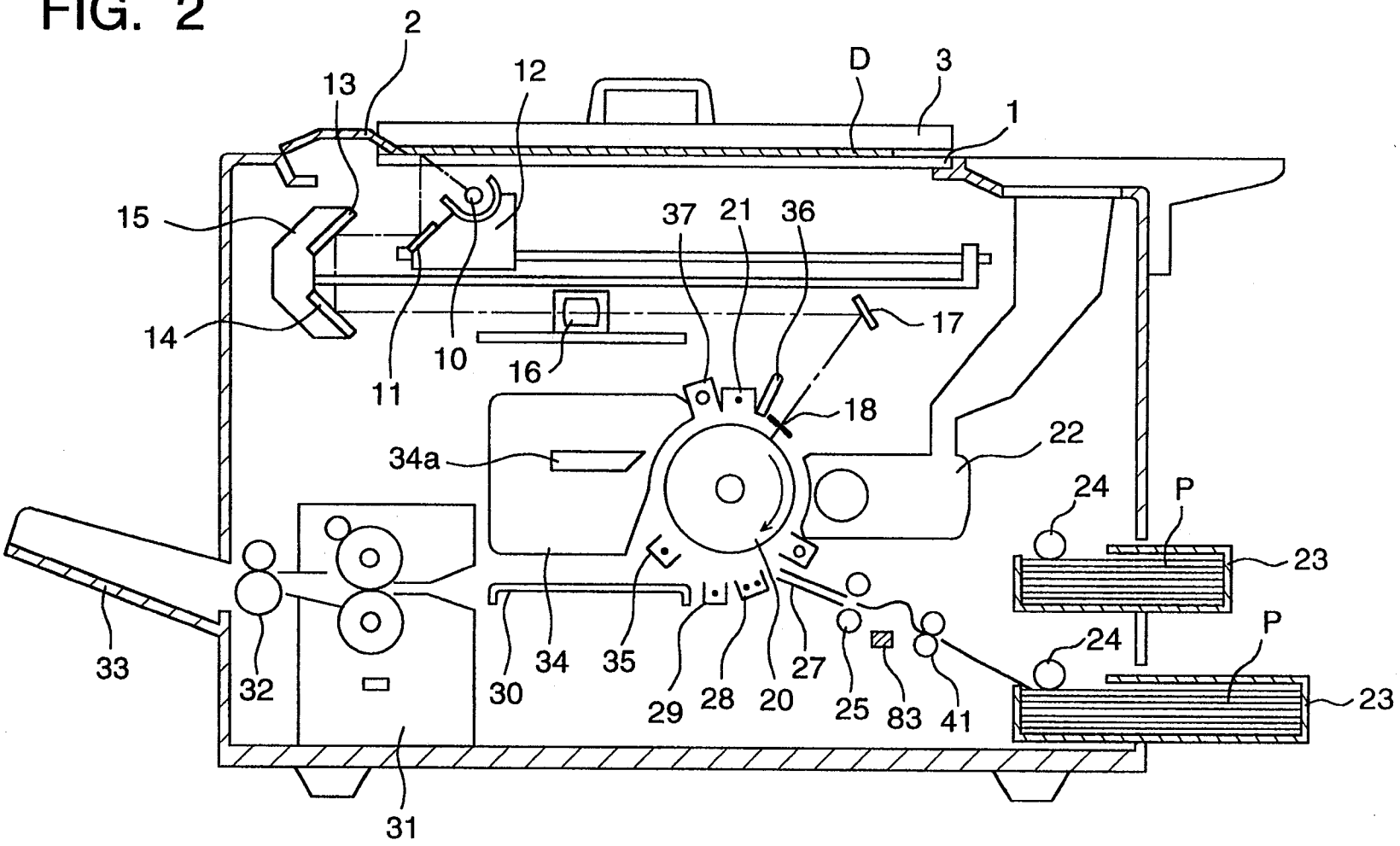
FIG. 2 is an overall arrangement view of an example of the present invention.

FIG. 1 is a block diagram showing the construction of an example of the present invention, and FIG. 2 is an overall arrangement view of an example of the present invention. Like parts in each of FIGS. 1, 2, 6 and 7 are identified by the same reference character. In FIG. 1, numeral 50 is an apparatus body, and numeral 60 is a control unit provided in the apparatus body 50. Numeral 61 is a register to hold a plurality of pieces of data of temporary stop time for each tray, the data being sent from the registration section. Numeral 62 is a reference value storing unit to store a reference value of temporary stop time. Numeral 63 is a nonvolatile memory to store the time from when the copying operation is started to when the first sheet feeding roller is turned on. Numeral 64 is a timer to measure the temporary stop time.

Numeral 70 is an operation unit connected with the apparatus body 50 through a signal cable. In the operation unit 70, numeral 4 is a display unit that displays the sheet size and the number of copies. Numeral 71 is a copy button by which a copy operation is started.

Numeral 80 is a drive unit connected with the apparatus body 50 through a signal cable. In the drive unit 80, numeral 81 is the first sheet feeding unit driven by the drive unit 80, and numeral 82 is the second sheet feeding unit also driven by the drive unit 80. For example, a motor and a magnetic clutch are used as a drive power source for the first and second sheet feeding sections. Numeral 83 is a temporary stop detection sensor to detect a transfer sheet that has been temporarily stopped. For example, a photosensor (PS) is used for the sensor 83. Numeral 90 is an optics driving unit connected with the apparatus body 50 through a signal cable. In the optics driving system, numeral 91 is an optical motor to conduct optical scanning.

In the units described above, the first sheet feeding unit 81 is mainly composed of the first sheet feeding roller 24 shown in FIG. 2, and the second sheet feeding unit 82 is mainly composed of the registration rollers 25. The arrangement of the temporary stop detection sensor 83 is shown in FIG. 2. The operation of the apparatus composed in the manner described above will be explained as follows.

When the copy button 71 is pressed, a copy start signal is sent out. The copy start signal is transmitted to the control unit 60 in the apparatus body 50 from the operation section 70. After a predetermined period of time has passed from when this copy start signal was received by the control unit 60, the first sheet feeding unit drive signal is given to the drive unit 80. The drive unit 80 drives the first sheet feeding unit 81 in accordance with this signal. As a result, a transfer sheet P is sent out from a predetermined tray 40 in the sheet feeding cassette 23.

After transfer sheet P has been sent out from the sheet cassette, it comes into contact with the registration rollers (the second sheet feeding rollers) 25. At this time, the temporary stop detection sensor 83 detects the stopped transfer sheet P. The output of this temporary stop detection sensor 83 is transmitted to the control unit 60 through the drive unit 80. When the transfer sheet stop signal is received by the control section 60, it sends a command to the drive unit 80 so that the operation of the second sheet feeding unit 82 is stopped. Specifically, the operation of the buckling rollers 41 is stopped. The control unit 60 starts measuring the temporary stop time of this transfer sheet P using a timer 64.

Figure 3:
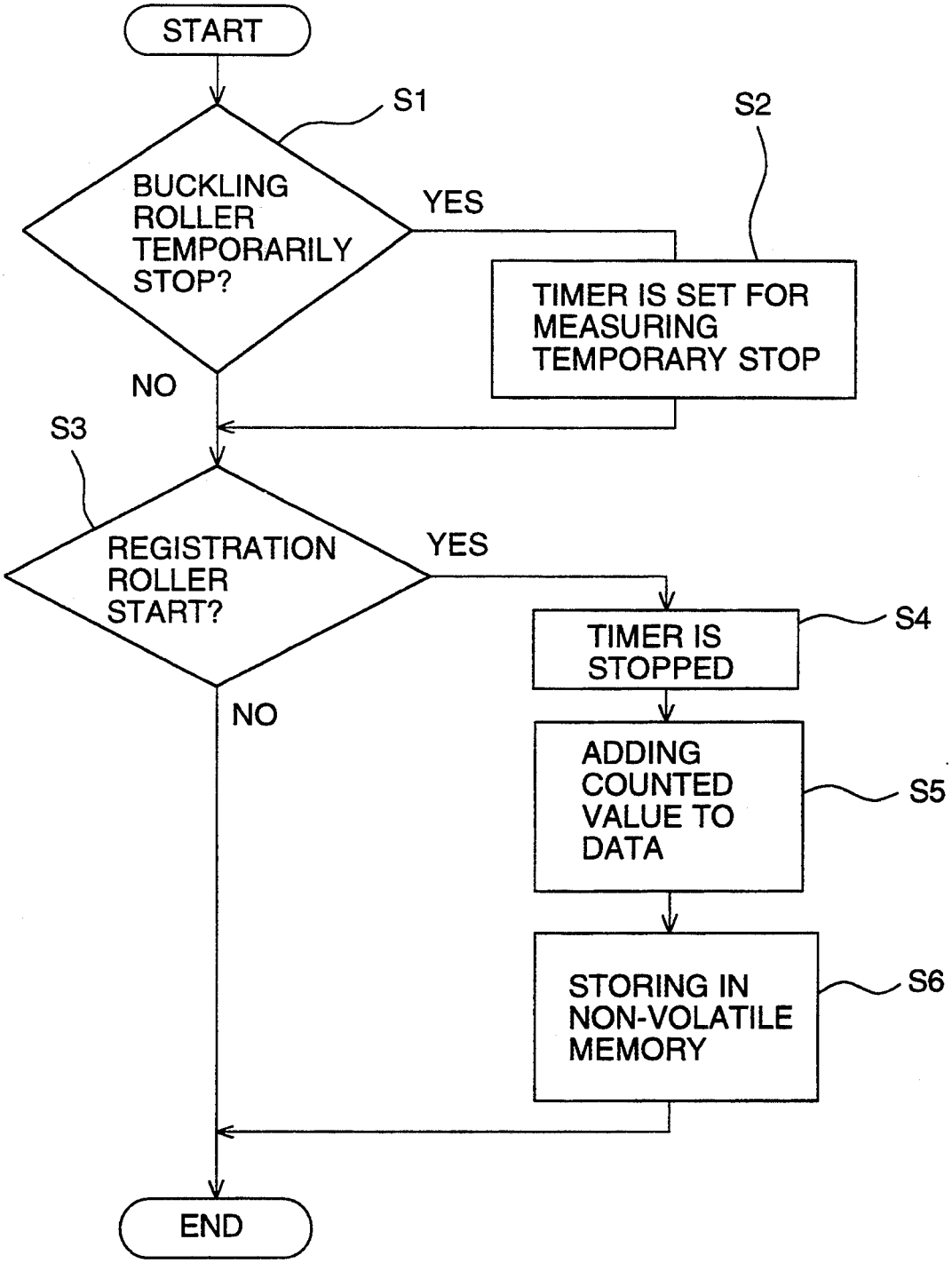
FIG. 3 is a flow chart showing a temporary stop time measurement operation.

FIG. 3 is a flow chart showing the temporary stop time measurement operation. First, the control unit 60 checks whether or not the buckling rollers 41 have been stopped (S1). After the buckling rollers 41 have been stopped, the timer 64 is activated so that the temporary stop time is measured (S2). When it is judged in step St that the buckling rollers 41 are not stopped, the control unit 60 sends a signal so that the optical motor 91 is started and an optical scanning operation is started.

After a predetermined period of time has passed from the start of the optical scanning, the drive unit 80 is given a command so that the second sheet feeding unit 82 is driven. That is, the registration rollers 25 are started. After the second sheet feeding unit has been started (S3), the control unit 60 stops the operation of the timer 64 for use in measurement of the temporary stop time (S4). The count value of the timer 64 is sent to the register 61 and accumulated to the data obtained till that time (S5). The added data is stored in the non-volatile memory 63 (S6).

While a plurality of copies are being made for the same sheet feeding cassette, the accumulated value of the temporary stop time is stored in the non-volatile memory 63 in accordance with the aforementioned sequence. Then, the control unit 60 calculates the average value of the temporary stop time in the case where the predetermined number of copies are made. Then, the found average value is compared with a reference value stored in the reference value storing unit 62. In accordance with the result of comparison, the first sheet feeding unit 81 is controlled so that it can be driven earlier.

Figure 4:
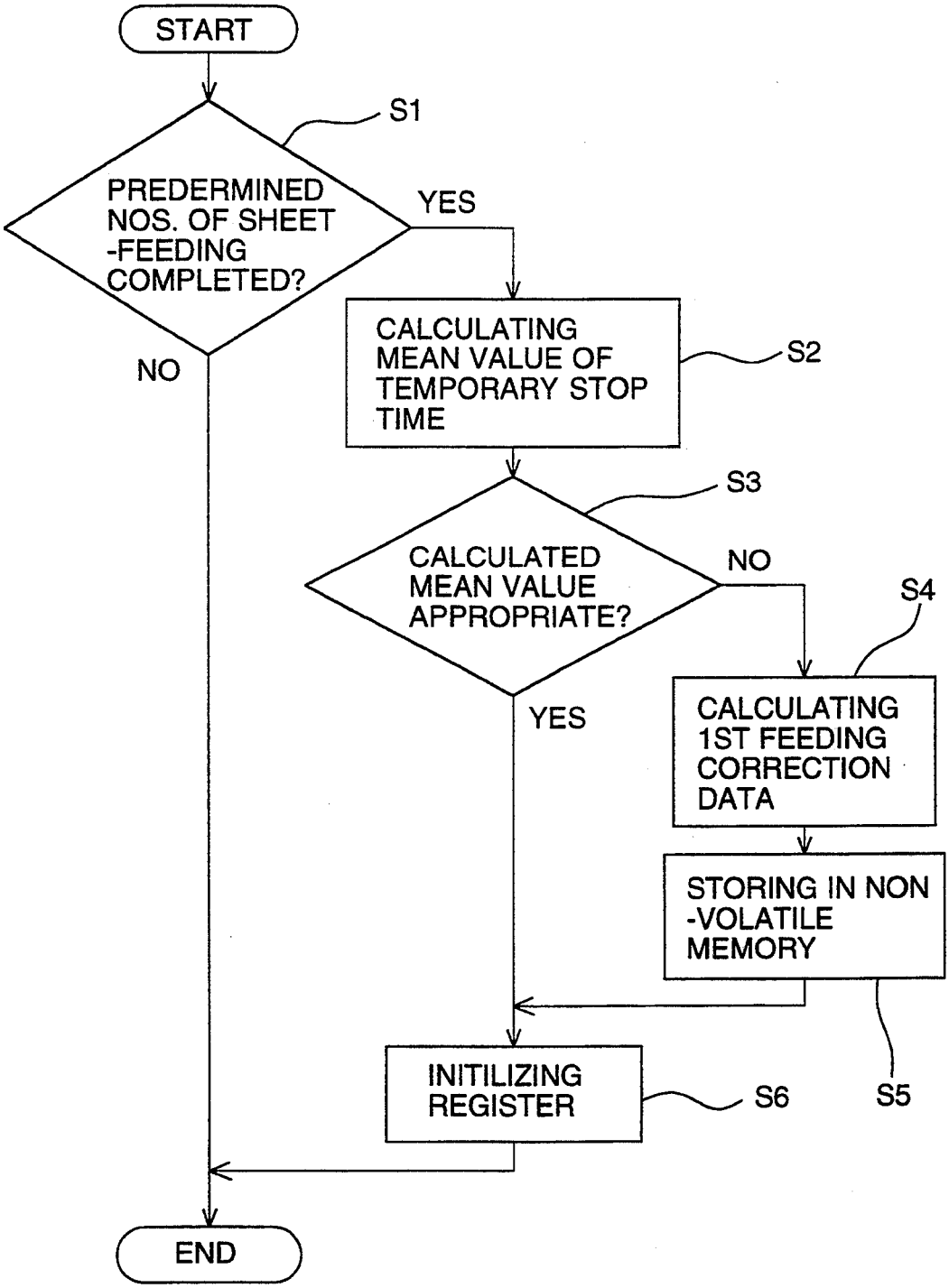
FIG. 4 is a flow chart showing a temporary stop time calculation and an adjustment operation.

FIG. 4 is a flow chart showing a temporary stop time calculation and an adjustment operation. First, the control unit 60 checks whether or not a predetermined number of transfer sheets have been sent out (S1). In the case where the predetermined number of transfer sheets have been sent out, the accumulated value of the temporary stop time stored in the non-volatile memory 63 is divided by the predetermined number of copies so that the average value of the temporary stop time is found (S3).

Next, the control unit 60 checks whether or not the calculated average value of the temporary stop time is in an appropriate range (S3). Specifically, the average value found in step S2 is compared with a reference value stored in the reference value storing unit 62 so that it is checked whether or not the average value is appropriate.

In the case where it is judged that the average value is not in the appropriate range, the control unit 60 calculates the first sheet feeding correction data (S4). Specifically, an amount of reduction of time from the start of the copy operation to the start of the first sheet feeding unit is determined. After the correction data has been found, the data is stored in the non-volatile memory 63 (S5). Finally, the register 61 is initialized (S6). In the next copy operation, in accordance with the correction data stored in the non-volatile memory 63, the first sheet feeding start signal is given to the first sheet feeding unit 81. As a result of the foregoing operation, the first sheet feeding operation is started earlier than the conventional case. Therefore, even when slippage of transfer sheet P occurs after the start of the first sheet feeding operation and it takes time for the transfer sheet to arrive at the second sheet feeding unit, the required temporary stop time can be ensured.

Figure 5:
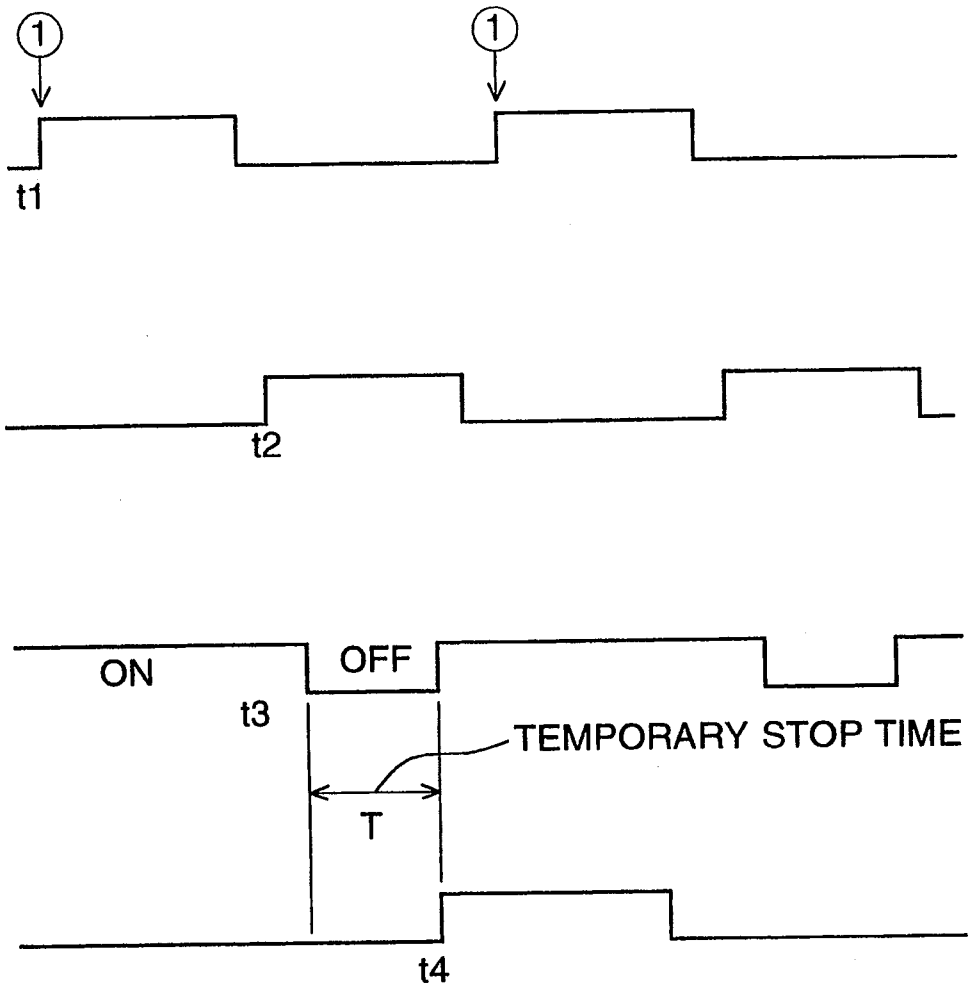
FIGS. 5(*a*) to 5(*d*) are time charts showing the operation of an example of the present invention.
Figure 6:
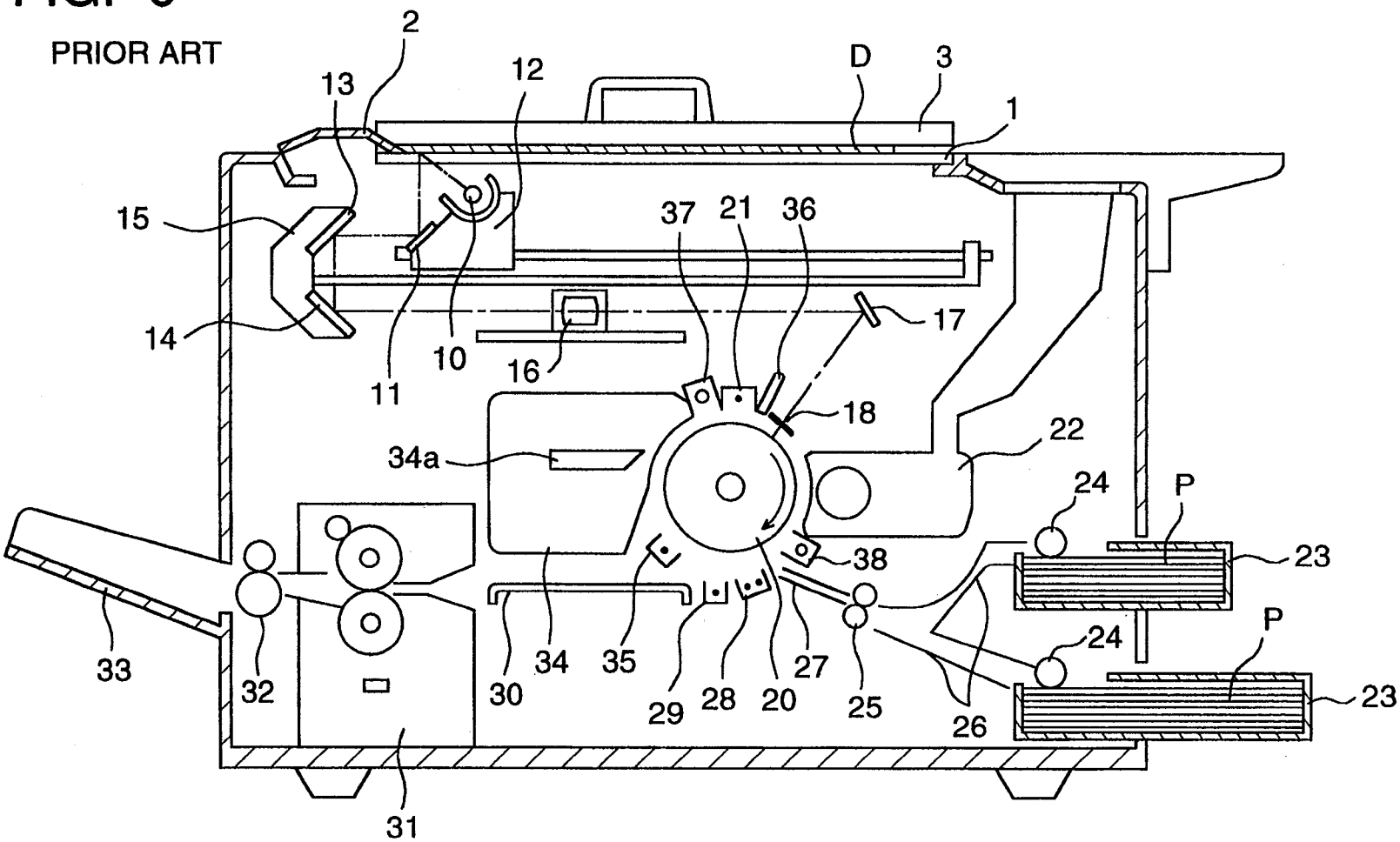
FIG. 6 PRIOR ART
FIG. 6 is an overall arrangement view of a conventional copying machine.
Figure 7:
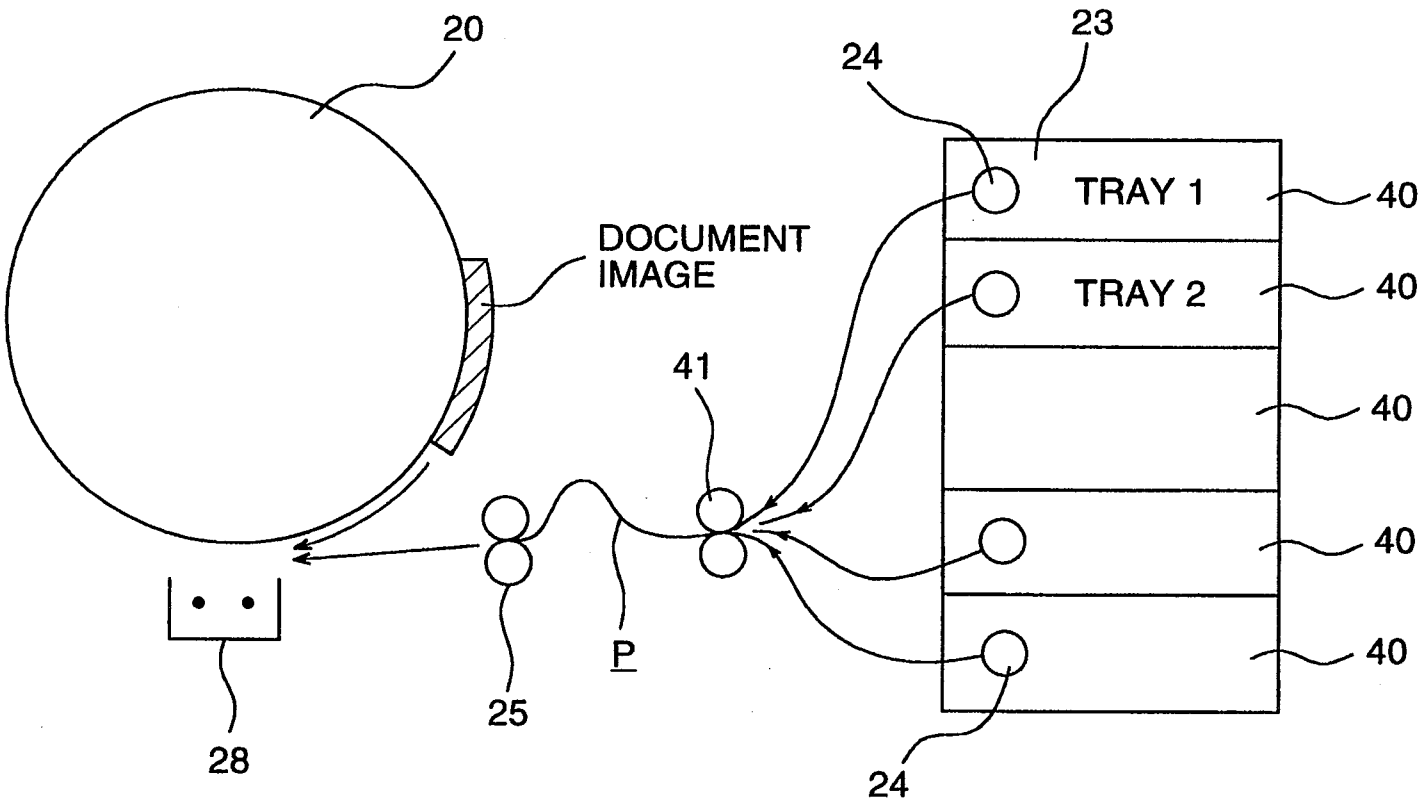
FIG. 7 is a schematic illustration showing the sheet feeding control conducted by registration rollers.

FIGS. 5(*a*) to 5(*d*) are time charts showing operations of the units of the present invention. FIG. 5(*a*) shows an operation of the first sheet feeding unit 81, FIG. 5(*b*) shows an operation of the temporary stop detection sensor 83, FIG. 5(*c*) shows an operation of the buckling roller, and FIG. 5(*d*) shows an operation of the second sheet feeding unit 82.

The first sheet feeding operation starts at time t1 shown in FIG. 5(*a*). Transfer sheet P sent out from the sheet feeding cassette 23 moves from the first sheet feeding unit 81 to the second sheet feeding unit 82. When transfer sheet P arrives at the second sheet feeding unit 82 and comes into contact with the registration rollers 25, the conveyance of transfer sheet P is forcibly stopped. As shown in FIG. 5(*b*), the temporary stop detection sensor 83 detects the stop of transfer sheet P at time t2.

When the temporary stop of transfer sheet P has been detected, the operation of the loop roller 41 is stopped at time t3 as shown in FIG. 5(*c*). At this time, transfer sheet P is temporarily stopped and its configuration is curved. After a predetermined period time has passed, as shown in FIG. 5(*d*), the second sheet feeding operation is started at time t4 in synchronization with a scanning operation conducted by the optical scanning system. A period of time T from time t3 to time t4 is defined as a temporary stop time, which is counted by the timer 64.

In the case where this temporary stop time has been shortened due to the deterioration with age of the sheet feeding unit, the first sheet feeding operation start time shown in FIG. 5(*a*) is advanced by the aforementioned correction data calculation. When the first sheet feeding operation start time is advanced as described above, the temporary stop time can be ensured to be a predetermined value. As a result, the sheet conveyance performance can be maintained at a predetermined level.

Of course, the present invention can be applied to both monochromatic and color copying machines. In the above explanation, a period of time from the start of a copying operation to the start of the first sheet feeding operation is shortened. In the case where a period of time from the generation of a copy start signal to the start of the second sheet feeding operation is reduced, the present invention can be applied in the same manner.

As explained above, according to the present invention, a copying machine can be provided in which the transfer sheet conveyance performance can be maintained at a constant level.

What is claimed is:

1. A copying apparatus comprising:

(a) a platen on which an original document is placed, an image of which is optically read and then processed being formed on an image carrier;

(b) at least one sheet feeding cassette for storing recording sheets thereon;

(c) a sheet feeder provided on said cassette for feeding recording sheets one by one toward said image carrier to transfer the processed image which has been formed on said image carrier on recording sheet; and (d) registering means for conveying the recording sheet fed by said feeder, for temporarily stopping the fed recording sheet in timed relation with the processed image on said image carrier, and for registering the processed image and the fed recording sheet; wherein each value of a period of time corresponding to a temporary stop of the recording sheets at said registering means fed by each cassette is used to calculate a mean value; and, upon comparing the calculated mean value with a predetermined reference value, a sheet feeding timing by said sheet feeder being advanced according to the comparison.

2. The copying apparatus of claim 1, wherein said registering means comprises register rollers, a temporary stop detecting sensor and buckling rollers, and when the leading edge of a recording sheet fed by said sheet feeder from said a sheet feeding cassette reaches said register rollers, said temporary stop detecting sensor detects the stop of the recording sheet, and after said buckling rollers stops during said temporary stop period of time, said register rollers starts the rotation in synchronization with said image carrier.

* * * * *